United States Patent [19]

Marsico

[11] 4,212,551

[45] Jul. 15, 1980

[54] RIBBON CARTRIDGE

[75] Inventor: Joseph A. Marsico, Paterson, N.J.

[73] Assignee: Litton Business Systems, Inc., Morris Plains, N.J.

[21] Appl. No.: 852,298

[22] Filed: Nov. 17, 1977

[51] Int. Cl.[2] ..... B41J 33/14

[52] U.S. Cl. ..... 400/208; 400/242

[58] Field of Search ..... 400/202.4, 207, 208, 400/208.1, 242; 242/71, 71.2

[56] References Cited

U.S. PATENT DOCUMENTS

| | | | |
|---|---|---|---|
| 1,561,945 | 11/1925 | Penin | 242/71.2 |
| 2,099,646 | 11/1937 | Busch | 242/71 |
| 2,936,883 | 5/1960 | Eichacker | 400/242 X |
| 2,986,260 | 5/1961 | Whippo | 400/208 |
| 3,151,724 | 10/1964 | Ross et al. | 400/208.1 |
| 3,272,304 | 9/1966 | Morelli | 400/208.1 |
| 3,349,887 | 10/1967 | Goff | 400/208 |
| 3,380,581 | 4/1968 | Landgraf | 400/242 X |
| 3,396,829 | 8/1968 | Knight | 400/202.4 |
| 3,513,957 | 5/1970 | Ricciardi et al. | 400/208 |
| 4,074,799 | 2/1978 | Hishida et al. | 400/208 |
| 4,088,218 | 5/1978 | Depew | 400/208 |

FOREIGN PATENT DOCUMENTS

| | | | |
|---|---|---|---|
| 2509840 | 9/1975 | Fed. Rep. of Germany | 400/208 |
| 1033405 | 4/1953 | France | 400/242 |
| 574820 | 4/1976 | Switzerland | 400/208 |

*Primary Examiner*—Ernest T. Wright, Jr.
*Attorney, Agent, or Firm*—Norman Friedman; Michael H. Wallach; Robert F. Rotella

[57] ABSTRACT

A ribbon cartridge for use in combination with a printing machine having a ribbon quantity sensor for reversing the direction of ribbon movement is provided. The cartridge has at least two spools therein with an inked ribbon attached to each spool and includes means for immobilizing both of the spools and means for locking each of the spools in a preferred position for insertion into the printing machine.

5 Claims, 6 Drawing Figures

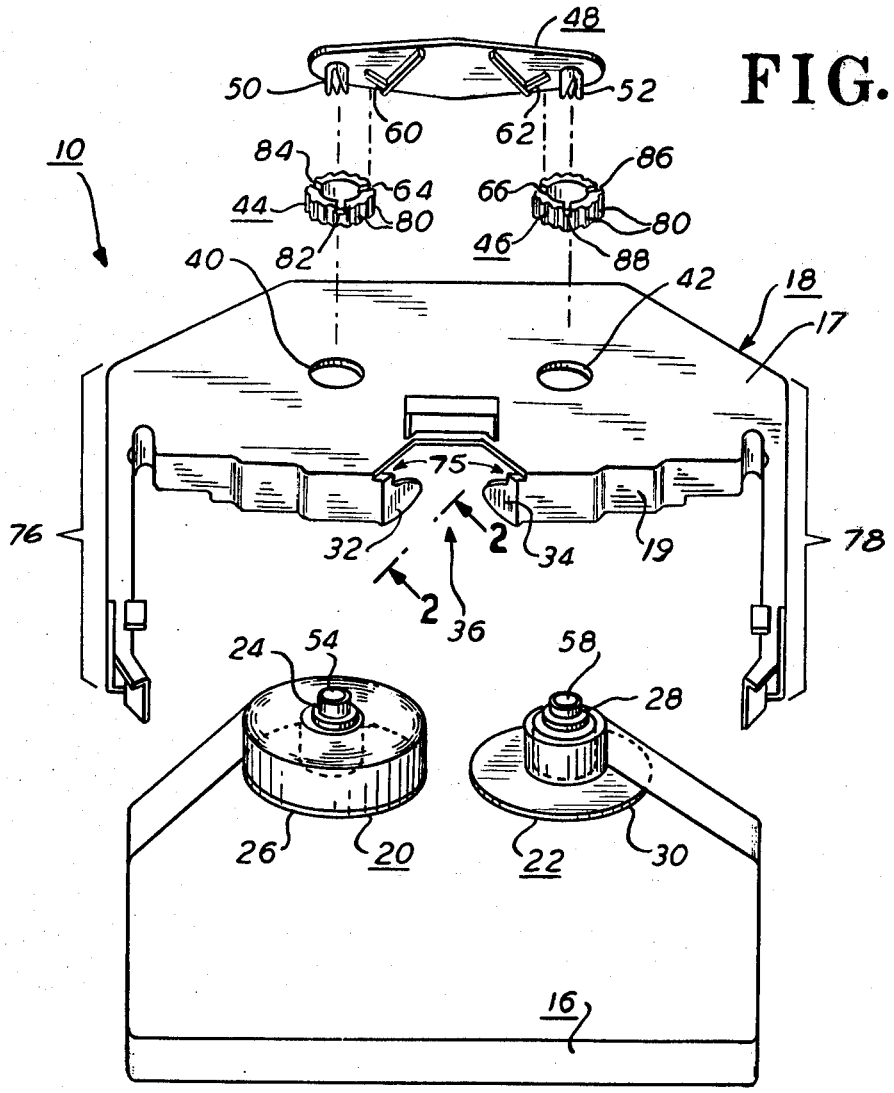
FIG. 1
FIG. 3
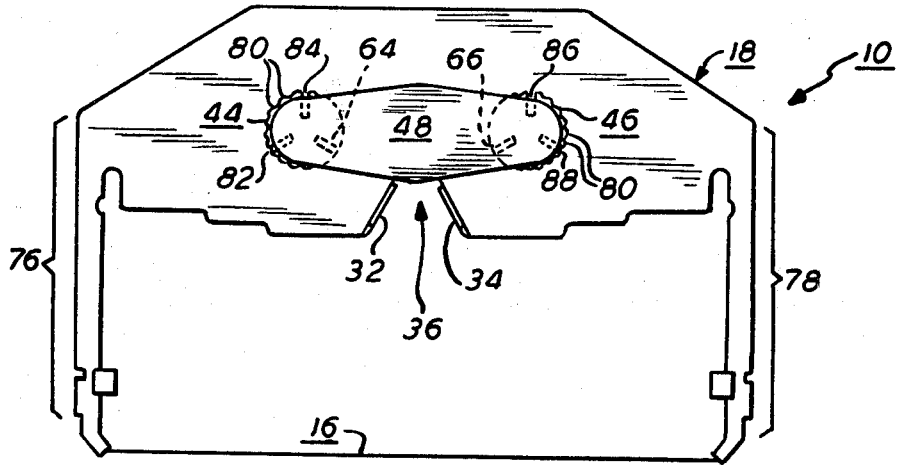

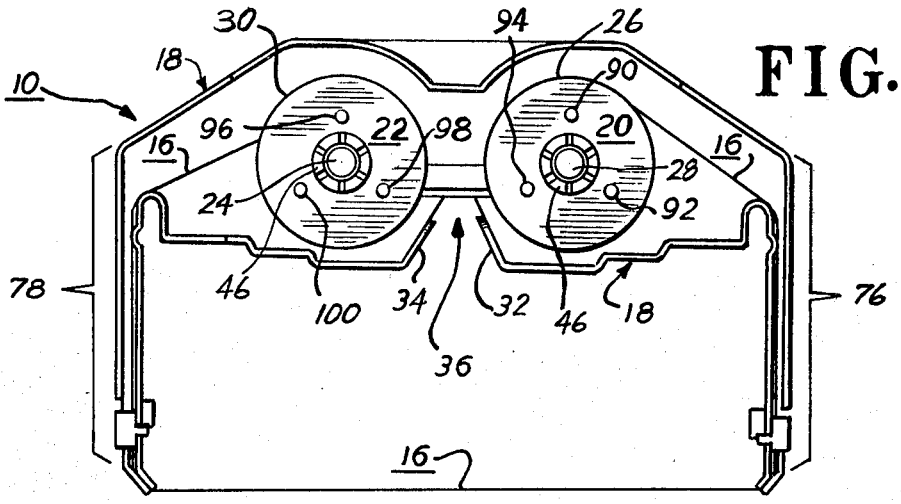
FIG. 4
FIG. 6
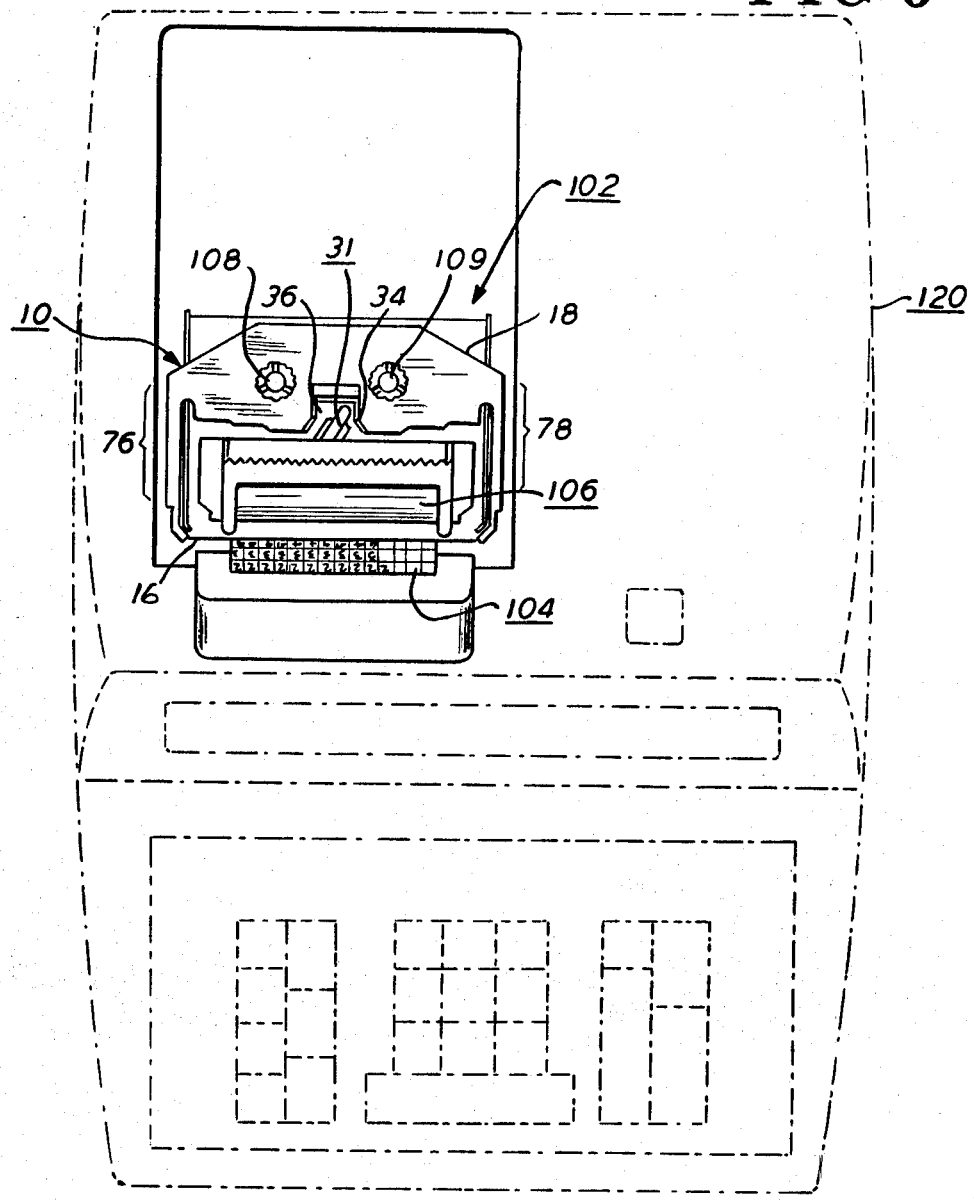

RIBBON CARTRIDGE

CROSS-REFERENCES TO OTHER APPLICATIONS

This application is related to copending applications, all assigned to the asignee of the present application and entitled "Ribbon Cartridge" bearing Ser. No. 848,136, filed on Nov. 3, 1977, in the name of John A. Garrido; Ser. No. 852,297, filed on Nov. 17, 1977, in the name of Joseph C. Sereika; and Ser. No. 853,556, filed on Nov. 21, 1977, in the name of Myron Beitler.

BACKGROUND OF THE INVENTION (1) Field of the Invention

This invention relates to an improved ribbon cartridge for use in a printing machine, and, more particularly, to a self-contained ribbon cartridge for use in a printing calculator of the type having a ribbon quantity sensing and reversing lever wherein the improved ribbon cartridge may be inserted into the printing machine with the ribbon taut, the spools immobilized, and the spools locked and oriented in a preselected and preferred position.

(2) Description of the Prior Art

The usual construction of a calculator printing mechanism prevents the insertion of ribbon in a self-contained cartridge. The mechanism construction is comprised of drive gears with axles attached thereto. Usually, a spool with an inked ribbon stored thereon is placed on the axle of one drive gear and a take-up spool is placed on the axle of the other drive gear. Typically, the spools have to be reoriented by rotation on the axles to properly seat them on engaging means located on each drive gear. In so inserting and reorienting the ribbon the inserter's hands often become soiled with ink from the ribbon. Also, the ribbon is sometimes loose and not properly taut after installation necessitating that the ribbon installer extend a hand into the printing mechanism at the location of either the take-up spool or the supply spool and adjust the tension on the ribbon.

Recently, self-contained ribbon cartridges have been developed for use in printing machines such as the printing electronic calculator. Such cartridges may perhaps possess various means for immobilizing the spools on which the inked ribbon is stored. However, no means is provided for positioning each spool on which ribbon is stored in a preselected and preferred position or orientation with respect to the cartridge such that when the cartridge is inserted into the printing machine of a calculator which has had its drive gears and engaging means thereon preoriented, adjustment or reorientation of the relative positions of the spools is unnecessary. This drawback wherein reorientation of the spools into a preselected position for insertion into the printing machine is necessary causes inconvenience to the operator of the calculator. In most instances, the relative positions of the two spools must be adjusted so that the cartridge can be seated within the printing machine and engage the drive gears for proper operation and movement of the individual spools within the cartridge.

The usual construction of a calculator printing machine prevents the random insertion of ribbon in a self-contained cartridge because the ribbon spools have engaging means thereon such as protruding fingers which must mate with other engaging means on the drive gears such as receptacles before the cartridge is properly seated for correct operation. Hence, heretofore means for reorienting the positions of these spools such as accessible ridged knobs connected to the spools were needed to properly seat the ribbon cartridge within the printing machine.

A ribbon cartridge in accordance with the present invention eliminates the necessity of having to reorient the ribbon spools prior to or after insertion of the cartridge into the printing machine.

SUMMARY OF THE INVENTION

The invention is a ribbon cartridge which is adapted for easy insertion into a printing machine by the addition of an immobilizing means having a means thereon for locking the ribbon spools in a preferred position without having to directly handle inked ribbon or manually readjust the relative positions of the spools or other means on which the inked ribbon is stored in order to secure proper seating of the ribbon cartridge in the printing machine.

IN THE DRAWING

FIG. 1 is an exploded view of an example of the invention.

FIG. 3 is a top view of an assembled example of the invention.

FIG. 4 is a bottom view of an assembled example of the invention.

FIG. 6 is a view of the invention in combination with an electronic printing calculator.

DESCRIPTION OF A PREFERRED EMBODIMENT

Figure 2:
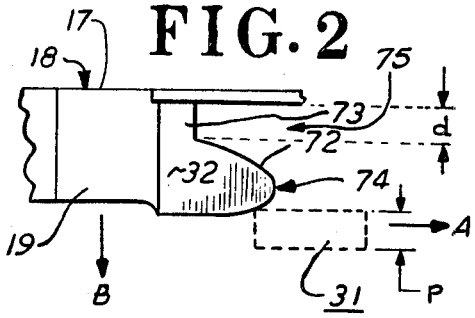
FIG. 2 is a magnified view of an aspect of the invention taken along section line 2—2 in FIG. 1.

Shown in FIG. 1 is an exploded view of a preferred embodiment of the invention. A ribbon cartridge 10 comprises at least two means for storing ribbon and a means for housing said ribbon and the ribbon storing means.

The ribbon storing means may be comprised of ribbon storing spools 20 and 22 made of plastic, for example. The spool 20 comprises a spindle 24 and a flange 26 located at one end of the spindle 24. Spool 22 has a spindle 28 and a flange 30 located at one end of the spindle 28. The ribbon 16 has one end connected to the spindle 24 and another end connected to the spindle 28.

The means for housing the ribbon 16 may be comprised of a generally C-shaped cassette 18 having a plastic housing, including an upper cover 17 and a side wall 19 extending downwardly from the upper cover 17 and, as shown in FIGS. 1 and 2, means for moving a ribbon quantity sensing and ribbon reversing member, such as a lever 31 (shown in cross-section in FIG. 2), which is attached to a printing mechanism (see FIG. 5) such that it does not obstruct the insertion of the cartridge 10 into the printer. This means for repositioning the ribbon quantity sensing and ribbon reversing member 31 may be comprised of a first cam 32 and a second cam 34 integrally attached to the cassette 18.

Figure 5:
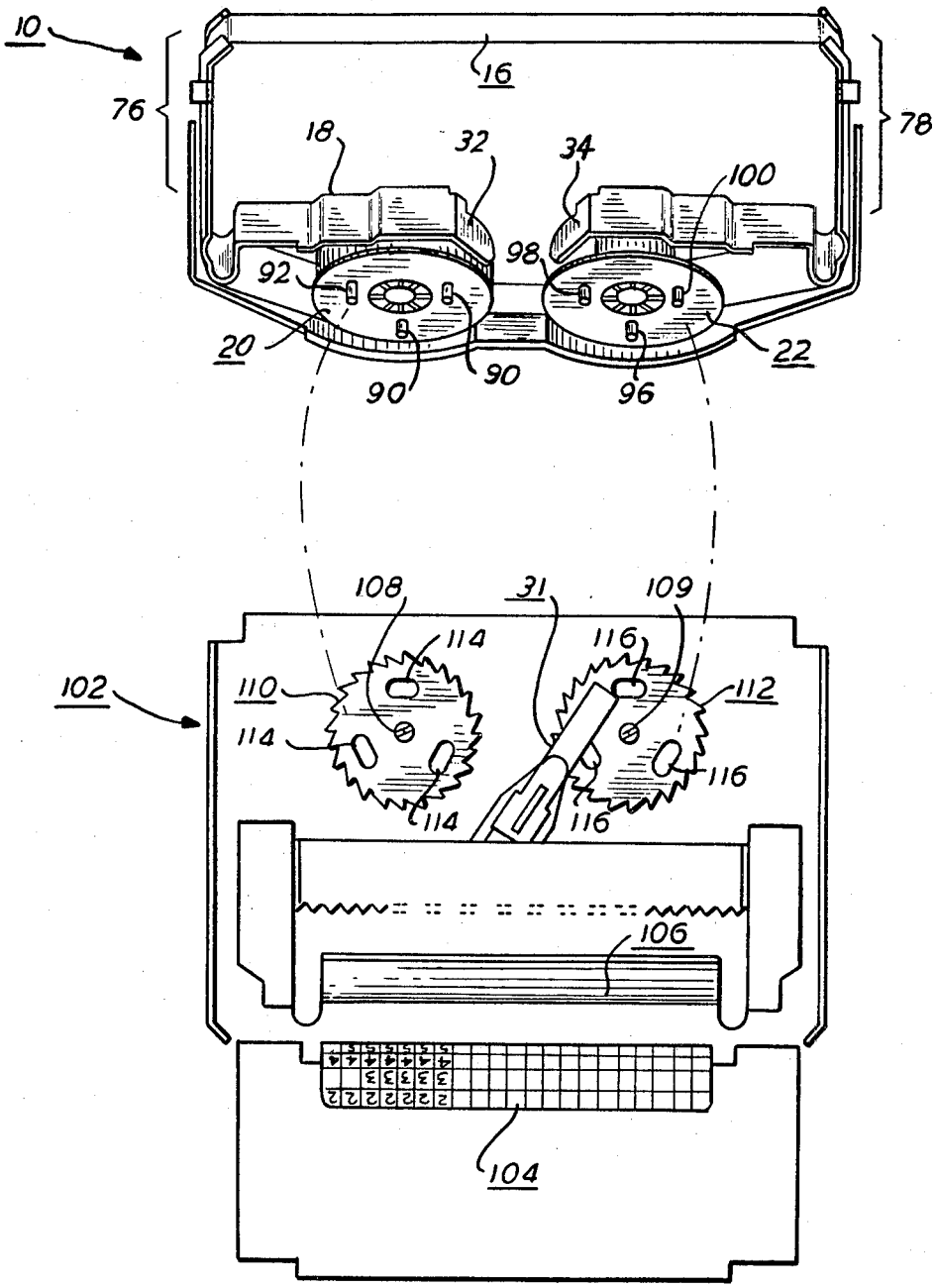
FIG. 5 is a modified perspective view of an example of the invention in combination with a printing mechanism.

The cassette 18 has an opening 36 into which the sensing lever 31 is directed by the action of the cams 32 and 34 upon insertion of the cartridge 10 into the printing mechanism (see FIG. 5).

The cassette 18 is bilaterally symmetric with respect to the opening 36 and has an open side, usually referred to as a bottom. The cam 32 is attached to one bilaterally symmetric half of the cassette 18 and the cam 34 is attached to another bilaterally symmetric half of the cassette 18 and extends to and borders the bottom of the cassette 18. Similarly, the cassette 18 has two bilaterally symmetric retaining means of a first kind, for example apertures 40 and 42 therein. The spindle 24 of the spool 20 is inserted through the aperture 40 and attached to the cassette 18 by a fastening means such as a ridged knob 44, for example. The spindle 24 is designed and adapted such that when fastened to the cassette 18 by the ridged knob 44, the spool 20 rotates freely within the aperture 40.

In a like manner, the spindle 28 of the spool 22 is inserted through the aperture 42 and fastened to the cassette 18 by a fastening means such as a ridged knob 46, for example. The spindle 28 is adapted for insertion through the aperture 42 and fastening therein by the ridged knob 46 in a fashion so as to permit the spool 22 to rotate freely.

Referring to FIG. 1, the spindle 28 may be characterized as having three distinct sections each having a different diameter, the diameters decreasing in size from the flange 30 toward the smallest diameter section onto which the knob 46 is fitted. The middle section of the spindle 28 is adapted to rotatably fit through the aperture 42.

The spindle 24 may be similarly characterized, and its middle section is adapted to rotatably fit through the aperture 40.

For proper insertion of the cartridge 10 and seating of the cartridge 10 in the printing mechanism 102 (see FIG. 5), means for holding the ribbon 16 taut as it is extended from the spool 20 to the spool 22 is required. An example of this means is a member 48. Generally, the member 48 is adapted for engaging a returning means of a second kind, axial holes in a spindle for example. The member 48 may comprise two attached connecting means such as protruding members 50 and 52 which are adapted for insertion into axial holes 54 and 58 in the spindles 24 and 28, respectively. Members 50 and 52 are each a tripartite structure with sufficient flexibility for tightly and removably fitting into the respective apertures 54 and 58 and immobilizing the spools 20 and 22 from rotation in the apertures 40 and 42, respectively.

The means for immobilizing the spools 20 and 22 from rotation, namely the member 48, further comprises a means for locking the spools 20 and 22 into a preselected and preferred position with respect to the cassette 18 and the member 48. This locking means comprises a pair of ridges 60 and 62 preferentially disposed on the member 48. These ridges 60 and 62 are designed and adapted to fit into the ridged knobs 44 and 46 at at least one preselected and preferred location on each at which grooves 64 and 66, respectively, have been formed therein. These grooves 64 and 66 are designed and adapted to receive and retain the ridges 60 and 62, respectively, in a manner which locks the ridged knobs 44 and 46, respectively into the preselected and preferred positions. This in turn locks the spools 20 and 22, respectively, into position since their spindles 24 and 28, respectively, are fixed in position by their frictional attachment to the knobs 44 and 46, respectively.

FIG. 2 shows a magnified view of the cam 32 shown in FIG. 1 as viewed along the section line 2—2. The cam 32 is substantially a mirror image of the cam 34. The cams 32 and 34 are obliquely oriented with respect to each other and cooperate to move a ribbon quantity sensing and reversing lever 31 into the aperture 36 centrally located in the cassette 18 only during insertion of the cartridge 10. After insertion the cams 32 and 34 are below the operating plane of the lever 31. Each of the cams 32 and 34 has a camming surface 72 which is designed such that it can transversely contact the lever 31 and move the lever 31 in a direction A as the cassette 18 is inserted into a printing mechanism by pressing in the direction B. It is essential that each camming surface 72 is spaced below the operating space and plane of the lever 31 after the cassette 18 is inserted and that the cassette 18 not interfere with movement of the lever 31 against either of the ink spools 20 and 22. This has been accomplished by providing a thin spacer 73 integral with the cam 32 and the cassette 18 and defining a recess 75 having a vertical length d at least equal to the thickness p of the lever 31.

The cam 34 is similarly constructed and also operates in this manner, but would move the lever 31 in a direction opposite to direction A.

The lever 31, when moved by either cam 32 or 34 comes to rest in a preferred position, a position which has been preselected by the arrangement, curvature, and extension of the cams 32 and 34. The lever 31 occupies a space which is complementary to a space occupied by the cartridge 10 in the printing mechanism, i.e. a nonobstructing space adjacent to that space occupied by the cartridge 10. As the cartridge 10 is pressed into a printing mechanism, if for example the sensing lever 31 is against the spool 20, the lever 31 is pivoted away from the spool 20 in the direction A until the lever 31 is in the aperture 36 or rests against the apex 74 of the cam 32 or a similar apex of the cam 34.

A camming surface 72 of the cam 32 may be characterized as either arcuate or substantially parabolic in shape. However, this shape is not critical to the function of the cams 32 and 34 as set forth herein and other shapes for similar members may accomplish movement of the lever 31 into an unobstructing position with respect to the cartridge 10. Each of cams 32 and 34 is designed to move the lever 31 simultaneously with the inserting movement of the cartridge 10 into the printing mechanism.

A top view of the cartridge 10 as assembled is shown in FIG. 3. There is shown the cassette 18 with an integral means for guiding the ribbon 16 away from a main body of the cassette 18 to a remote location within a printing mechanism. This guide means facilitates insertion of the ribbon 16 into a printing mechanism of the type comprising a platen and a printer in between which the ribbon 16 must travel. The guide means comprises arms 76 and 78 through which the ribbon 16 travels and is guided away from the spool 20 toward the spool 22 (and vice versa when the direction of travel of the ribbon 16 is reversed).

Referring to FIGS. 1 and 3, parallel indentations 80 may be observed on the knobs 44 and 46. These indentations 80 facilitate gripping the knobs 44 and 46 for adjustments. In addition to the grooves 64 and 66 covered by the member 48, there exist other similar grooves 82 and 84 on the knob 44 and additional similar grooves 86 and 88 on the knob 46.

As shown in FIG. 4, the ridged knob 44 is attached to the spindle 24 of the spool 20 in a manner such that the grooves 82, 84, and 64 are prealligned to correspond respectively to a group of means for rotatably engaging a spool driving means such as three protruding fingers 90, 92, and 94, for example, equally spaced from the spindle 24, circularly spaced 120° apart and attached to the flange 26 of the spool 20. Likewise, the ridged knob 46 has grooves 86, 88, and 66 which correspond to protruding fingers 96, 98, and 100 directly underneath on the flange 30 of the spool 22.

FIG. 5 shows the ribbon cartridge 10 in relationship to a printing mechanism 102. The spools 20 and 22 are locked into a preselected and preferred position and immobilized. The spools 20 and 22 are locked in a manner which maintains the ribbon 16 taut and facilitates and improves insertion of the cartridge 10 into the printing mechanism 102.

The printing mechanism 102 is comprised of a printer 104, a platen 106, and laterally spaced axles 108 and 109 positioned so as to receive the spools 20 and 22 held within the cassette 18 of the ribbon cartridge 10. The axles 108 and 109 have attached thereto spool driving means such as drive gears or geared flanges 110 and 112, respectively, for driving the spools 20 and 22. The geared flange 110 has openings 114 therein arranged and spaced so as to receive the protruding fingers 90, 92, and 94 of the spool 20 when the spool 20 is oriented by the member 48 (see FIGS. 1 and 3). Likewise, the geared flange 112 has openings 116 therein which are arranged and spaced so as to receive each of the protruding fingers 96, 98 and 100 of the spool 22 when the protruding members 96, 98 and 100 and geared flange 112 are each in their aforedescribed preferred and preselected position.

Shown in full view in FIG. 5 is the lever 31 which senses the amount of the ribbon 16 adjacent either the axle 108 or the axle 109 and shifts to the opposite one of the axles 108 and 109 when the spool 20 or 22 the lever 31 is most proximate to, becomes full. When the lever 31 moves to the opposite axle 108, 109 or spool 20, 22, the movement of the lever 31 activates a mechanism (not shown) which reverses the direction of movement of the ribbon 16.

Shown in FIG. 6 is the cartridge 10 in combination with the printing mechanism 102 as part of an electronic printing calculator 120. The cartridge 10 is shown with the cassette 18 within the housing of the printing mechanism 102. As heretofore mentioned, the arms 76 and 78 guide the ribbon 16 away from the main body of the cassette 18 in between the printer 104 and the platen 106. The ribbon quantity sensing and reversing lever 31 is visible in the aperture 36 of the cassette 18. The lever 31 rests against the cam 34 and in a position most proximate to the axle 109.

As many other embodiments of the invention may be made and as many changes in the preferred embodiment above disclosed are possible, it will be understood that the foregoing is to be interpreted in an illustrative rather than limiting sense and that various omissions and substitutions and changes in the form or details of the structure of the device illustrated and in its operation may be made by those skilled in the art without departing from the spirit of the invention.

It is the intention therefore to be limited only as indicated by the following claims.

What is claimed is:

1. In a ribbon cartridge for insertion into a printing machine having a printer, a spool drive means, and a platen wherein the cartridge comprises:

a cassette;

an inked ribbon in said cassette for extending between said printer and platen;

movable means in said cassette for storing said ribbon connected thereto, said movable means comprising spools, each of said spools having a spindle and a flange at one end of said spindle;

means attached to each of said flanges for rotatably engaging said spools with said spool drive means;

fastening means connected to each of said spindles for fastening said spools to said cassette;

locking means detachably mounted on said cassette for locking said spools in a preselected position in said cassette along a given direction of movement of said ribbon from one of said spools toward said printer and platen for engagement of said means for rotatably engaging said spools with said spool drive means;

said locking means comprising at least two ridges, each of said ridges engaging one of said fastening means and locking one of said spools in said preselected position;

whereby said spools are locked so that said spool drive means may be engaged by said means for rotatably engaging said spools with said spool drive means.

2. A ribbon cartridge according to claim 1 wherein said cassette has retaining means therein for receiving the unflanged ends of said spools.

3. A ribbon cartridge according to claim 1 wherein said fastening means is a knob having a groove therein for receiving one of the ridges.

4. A ribbon cartridge according to claim 1 wherein each of said ridges fit into a groove.

5. A ribbon cartridge according to claim 3 wherein said means for rotatably engaging said spool drive means is a protruding finger and said drive means is a geared flange with an aperture therein for receiving said finger.

* * * * *